United States Patent [19]

Greenlees

[11] 4,223,447

[45] Sep. 23, 1980

[54] WRITING GUIDE FOR CLIPBOARD OR THE LIKE

[76] Inventor: James C. Greenlees, 399 Asharoken Ave., Northport, N.Y. 11768

[21] Appl. No.: 62,301

[22] Filed: Jul. 31, 1979

[51] Int. Cl.[3] ..... B43L 13/02

[52] U.S. Cl. ..... 33/443; 35/38

[58] Field of Search ..... 33/430, 436, 437, 438, 33/443, 445, 446, 447, 448, 450, 454, 477, 174 B; 35/38

[56] References Cited

U.S. PATENT DOCUMENTS

| | | | |
|---|---|---|---|
| 760,211 | 5/1904 | Jones | 33/443 |
| 1,263,147 | 4/1918 | Tanron | 35/38 |
| 1,372,360 | 3/1921 | McNeil | 35/38 |
| 2,080,093 | 5/1937 | Rose | 33/174 B |

FOREIGN PATENT DOCUMENTS

| | | | |
|---|---|---|---|
| 296932 | 9/1928 | United Kingdom | 35/38 |

*Primary Examiner*—Harry N. Haroian
*Attorney, Agent, or Firm*—Edward H. Loveman

[57] ABSTRACT

A writing guide for writing letters and words in a transverse line on a sheet mounted on the flat surface of a baseboard, includes a rectangular frame movable along a detent rod carried by the baseboard. The frame is rotatable around the rod to enable the sheet to be placed on and removed from the baseboard. The frame has two rigid spaced rails joined by rigid end plates. A flexible string has two laterally movable sections disposed between and parallel to the rails to define a space for writing transversely along the sheet. The string may be connected in electric circuit with an electrically operable sounding device, power supply, and metal tip of a writing implement, to sound an alarm when the tip of the writing implement contacts one of the string sections.

9 Claims, 13 Drawing Figures

WRITING GUIDE FOR CLIPBOARD OR THE LIKE

This invention is concerned with a guide for writing on a flat sheet or card mounted on a flat clipboard, baseboard or the like, and more specifically relates to a writing guide for permitting blind persons or those having poor vision to write in straight lines across a sheet.

In a prior writing guide, a shaft mounted at the left edge of a flat clipboard has a plurality of detent notches. A rectangular carriage frame having two rigid spaced transverse rails is movable along the shaft. The carriage frame is stopped at each detent notch by a ball and spring mounted at the left end of the carriage frame. The prior writing guide has the disadvantage that the rigid spaced transverse rails interfere with writing. The tops of letters can be chopped off, i.e., when writing a "d" the rigid top rail will prevent writing the top vertical section of the letter so that the letter appears like an "o"; in writing an "h" the rigid top rail will prevent writing the top vertical section of the letters so the letter appears like an "n". Similarly the rigid top rail will interfere with writing "l" and "t" unless the writer can write unusually small letters. If the writer writes letters such as "g", "q" and "y" the rigid bottom rail will interfere with writing the bottom tails of the letters. If the writer writes high or low in the narrow available space, the rails will interfere with completion of all letters when the point of the writing instrument encounters either top or bottom rail.

The present invention is directed at overcoming the above and other difficulties and disadvantages of the prior and similar types of writing guides. In the present invention there is provided a writing guide comprising a rectangular frame which may be mounted on a shaft for lateral movement. A flexible metal or plastic string, like a guitar string, may be carried by the rectangular frame. The string is stretched between two lateral end bars or rails of the frame transversely across the space between rigid upper and lower rails of the writing frame. The string can be entrained or engaged around abutment underneath the left one of the lateral end bars which rides along the shaft or rod. Ends of the string are engaged in a block disposed adjacent to the right other lateral end bar of the writing frame. The block is connected to the writing frame by pins on which the block can slide laterally, and by coil springs which hold the block yieldably spaced from the right end bar of the writing frame. Ends of the string are secured in holes in the block.

When the writing guide is in use by a person with poor vision, the writing implement or person's writing hand will contact the upper or lower string section. The flexible string will yield sufficiently to permit the letter being written to be completed. The upper string section will move upwardly or the lower string section will move downwardly as much as the string in the end block will permit, while the block is drawn toward the rignt end bar of the writing frame.

If the string has ridges like a wire wound guitar string, the writer's fingernail or the writing implement will make a scratching sound when it contacts and moves along the string. This will serve as an audible indication of contact of the upper or lower string by the writing implement, and as an indication of the location of the writing implement along the line being written. The writing guide can also be provided with a movable pointer to overlay the top or bottom rail of the writing frame. This pointer will be movable to locate and indicate a particular position or point along the writing line.

It is also possible, according to the invention, to connect the flexible string in circuit with one terminal of a battery and a buzzer or other sounding device. The writing implement will have an electrically conductive tip connected in the electric circuit via a flexible cable. When the writing implement touches either the upper or lower string section, the sounding device will emit an audible alarm indicating that the writing implement is hitting or touching the string.

It is, therefore, a principle object of the present invention to provide a writing guide for writing letters and words in a transverse line on a sheet of paper mounted on the flat surface of a baseboard.

It is another objective of the present invention to provide a writing guide which has flexible string which yields sufficiently to permit writing to be completed.

It is still another object of the present invention to provide a writing guide having means for providing audible indications of contact of the writing instrument with the surfaces of the writing guide.

These and other objects and many of the attendant advantages of this invention will be readily appreciated as the same becomes better understood by reference to the following detailed description when considered in connection with the accompanying drawings in which.

Figure 1:
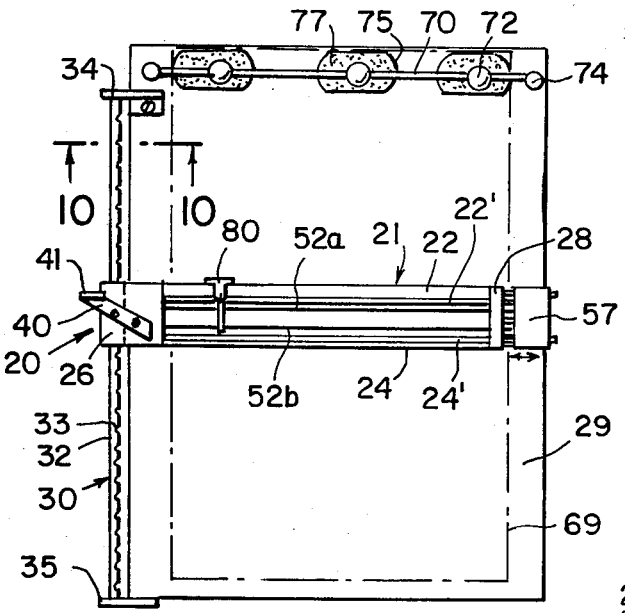
FIG. 1 is a top plan view of a clipboard provided with a writing guide embodying the invention.

Referring now to the drawings, wherein like reference characters designate like or corresponding parts throughout, there is illustrated in FIGS. 1–9, a writing guide generally illustrated as reference numeral 20 comprising a rectangular frame assembly 21 having straight upper and lower rails 22, 24 joined in spaced, parallel, coplanar position by a pair of end plates or bars 26, 28 to form a rigid structure.

Figure 10:
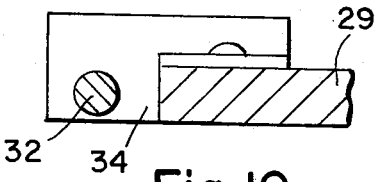
FIG. 10 is an enlarged fragmentary sectional view taken along line 10—10 of FIG. 1.

The writing guide 20 is arranged for movement along the upper side of a baseboard 29 of a clipboard assembly 30. At the left edge of the baseboard 29 is a rod or shaft 32 having a plurality of detent notches 33 spaced therealong. The rod 32 is held in spaced position from the left edge of the baseboard 29; see FIGS. 1 and 10. An end plate or bar 26 of the frame assembly 21 has a depending portion 36 having a bore 38 through which the rod 32 passes. By this arrangement the writing guide 20 can slide along the baseboard 29 from the top to the bottom of the rod 38, with the rails 22, 24 extending transversely across the baseboard 29 and slightly spaced therefrom. Each of the rails have 22, 24 respective inwardly beveled edges 22' and 24'. A bracket 40 is secured to the end plate 26 and has a handle 41 extending upwardly therefrom for manually moving the writing guide 20 up or down along the baseboard 29.

In order to hold the frame assembly 21 in stationary position at each detent notch of the rod 32, there is provided a coil spring 42 set in a bore 44 in the end plate 26 and held there by a screw 46. A ball bearing 48 at the inner end of the spring 42 engages yieldably in each of the detent notches 33 to hold the writing guide 20 stationary; see FIGS. 5 and 5A.

Figure 3:
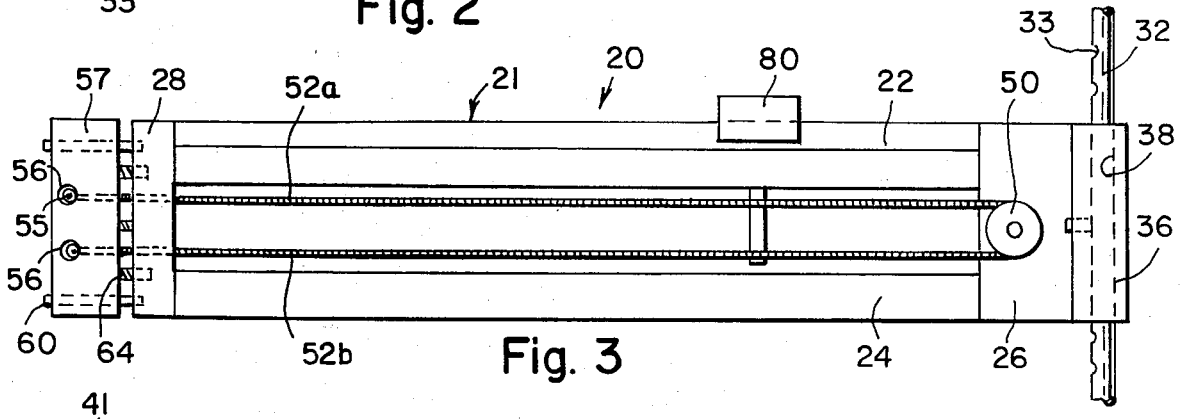
FIG. 3 is a bottom plan view of the writing guide or the same scale as in FIG. 2.
Figure 4:
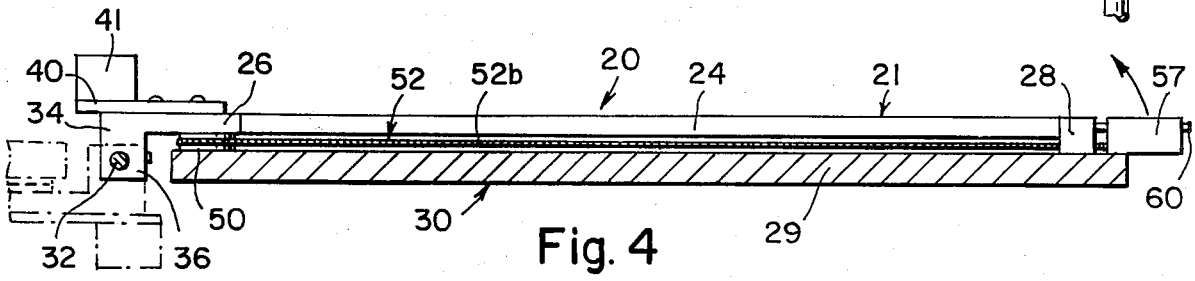
FIG. 4 is a transverse sectional view of the clipboard taken along line 4—4 of FIG. 2, showing the writing guide in end elevation.
Figure 5:
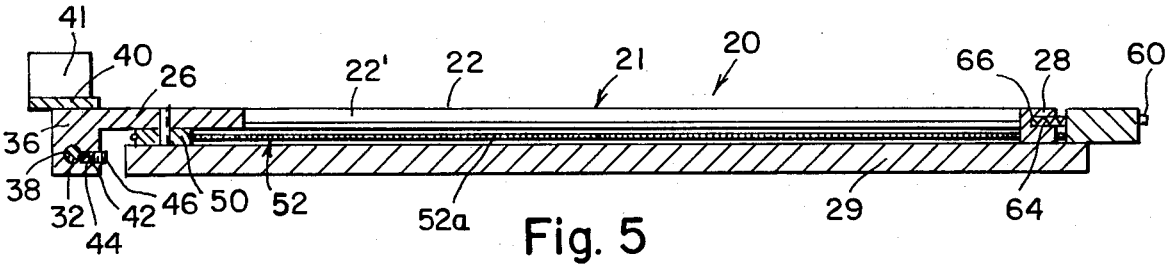
FIG. 5 is a sectional view taken along line 5—5 of FIG. 2.
Figure 5A:
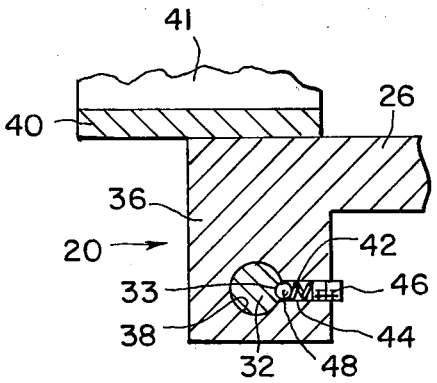
FIG. 5A is a further enlarges portion of the left end of FIG. 5.
Figure 6:
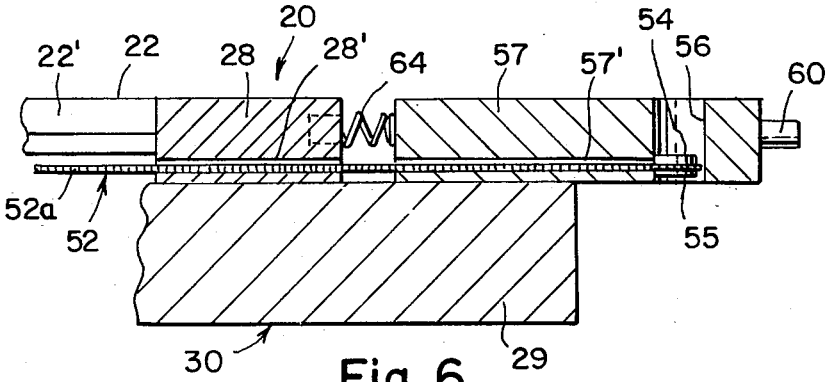
FIGS. 6, 7, 8, 9, 11 are further enlarged fragmentary sectional views taken along lines 6—6, 7—7, 8—8, 9—9, and 11—11 respectively of FIG. 2.
Figure 9:
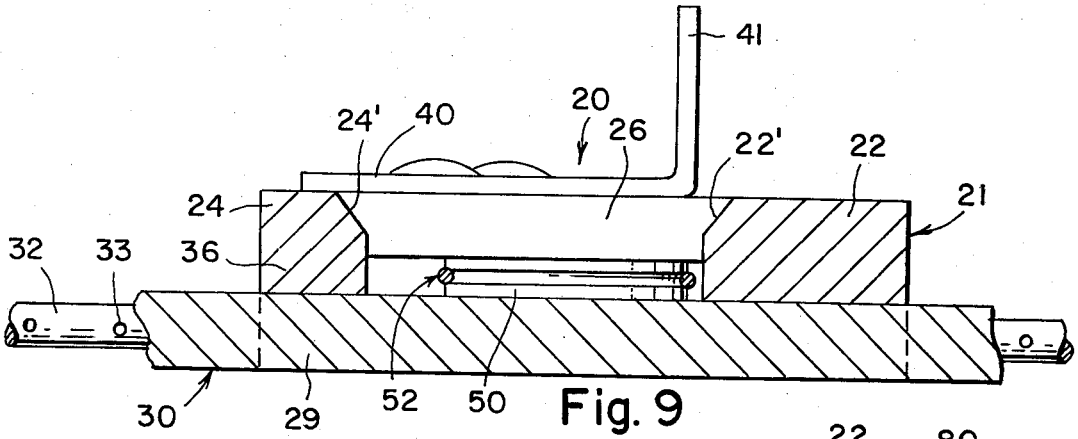

Secured to the undercut portion of the plate 26 (as best shown in FIGS. 3, 5, and 9), is a pulley-like abutment 50 around which is engaged a flexible wire string 52. Each end 54 of the string 52 is engaged on a respective eyelet 55 in a respective hole 56 formed in a flat block 57 disposed in coplanar position with the frame assembly 21 adjacent the end plate or bar 28. Upper and lower coplanar sections **52*a* and 52*b* of the string 52 are disposed in parallel relationship in the space between the beveled inner edges 22' and 24' of the respective rails 22, 24. The string sections 52*a* and 52*b* are spaced from the adjacent inner edges 22', 24' of the rails. Each of the string sections 52*a*, 52*b* pass through a respective bore 28' in the end plate 28 and through a respective bore 57' in the block 57; see FIGS. 6, 8**.

Figure 7:
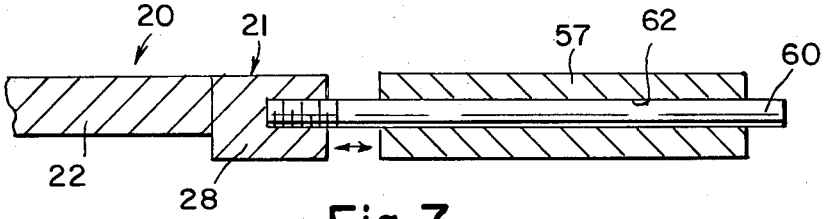
Figure 8:
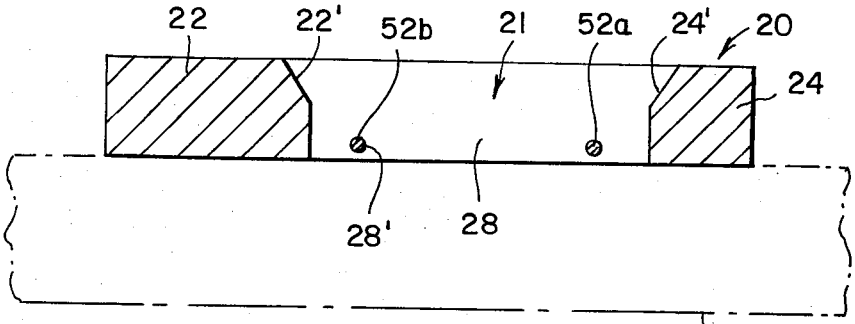

A pair of stationary pins 60 secured in the end plate 28 extend through respective bores 62 in the block 57; see FIG. 7. This arrangement enables the block 57 to slide laterally to the left and right with respect to frame assembly 21. A coil spring 64 is set in each of three recesses 64 in the plate 28 and each has a right end engaging the left inner edge of the block 57 to hold the block 57 yieldably spaced from the end plate 28; see FIGS. 1, 2, 3, 5, 6.

In moving along the top of the baseboard 29, the end plates 26 and 28 ride on the baseboard 29. The block 57 also rides on the baseboard 29.

In operation, the writing guide 20 may be moved along the baseboard 29 from the detent notch 33 to another detent notch 33. The spacing of the notches 33 set the predetermined spaces of the lines to be written on a sheet 69, indicated by dotted lines in FIG. 1, to be placed on the baseboard 29 underneath the writing guide 20. The sheet 69 may be held in place by an elastic band 70 near the upper edge of the baseboard 29; see FIG. 1. The band 70 may carry beads 72 through which the band 70 is threaded. Ends of the band 70 are engaged on stationary posts 74. Tabs 75 with rough surfaces 77 underneath the beads 72 provide frictional engagement with the paper sheet 69. To facilitate insertion of the sheet 69 on the baseboard 29, the writing guide 20 may be rotated 180° on the rod 32 to the outward position shown in FIG. 3 and by dotted lines in FIG. 4.

Figure 2:
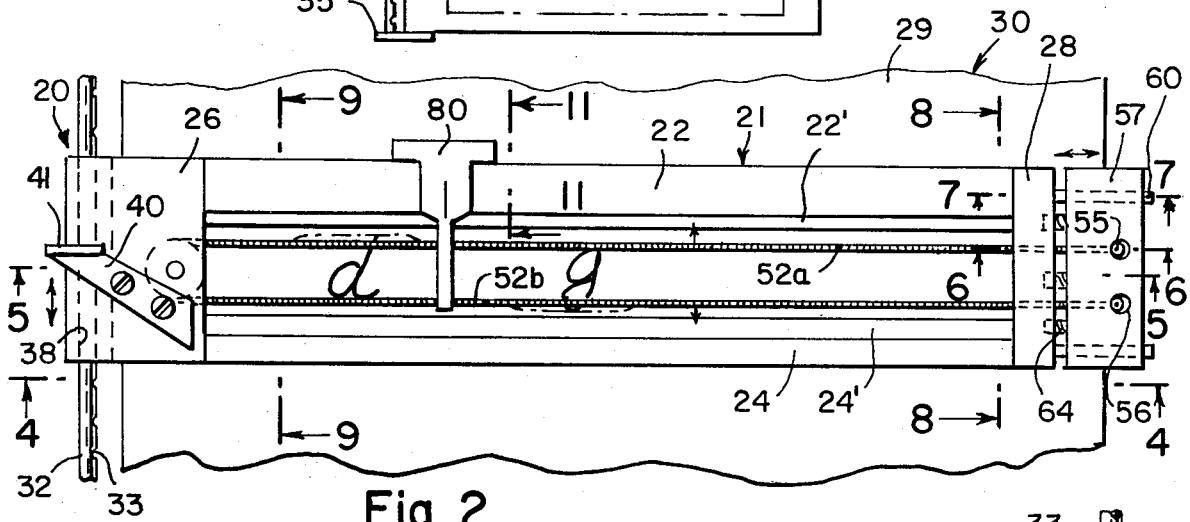
FIG. 2 is an enlarged fragmentary plan view of the clipboard showing details of the writing guide.

A writing implement 110 may be placed on the sheet 69 between the string sections **52*a*, 52*b* for writing a line of symbols or words. Suppose the writer is writing the letter "d", then as indicated in FIG. 2, the upper string section 52*a* can yield to a dotted line position L1 to permit the upper portion of the letter to be completed. Suppose the letter "g" is being written, then the lower string section 52*b* yields as indicated by a dotted line L2 in FIG. 2 to permit the lower portion of the "g" to be written in full. When either string section yields, end block 57 is drawn toward the end plate 28 on the pins 60 while the springs 64 are compressed. When the string section is released, the springs 64 expand restoring the block 57 to its normal spaced position. The writing guide 20 can always be rotated to the inverted outward position of FIG. 3, for viewing the entire written line and for removing the sheet 69**.

Figure 11:
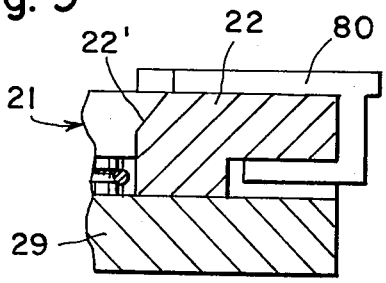

If desired a pointer 80 may be mounted on one of the rails 22 or 24 of the writing guide 20. As shown in FIGS. 1, 2, 3, and 11, the pointer 80 is slidable along the rail 22. The pointer 80 is a springlike clip bent in rectangular J shape as best shown in FIG. 11 to engage frictional opposite sides of the rail 22. This pointer can be manually set along the frame assembly 21 to any desired position to indicate the beginning, end, or any desired writing point along the line of writing.

Figure 12:
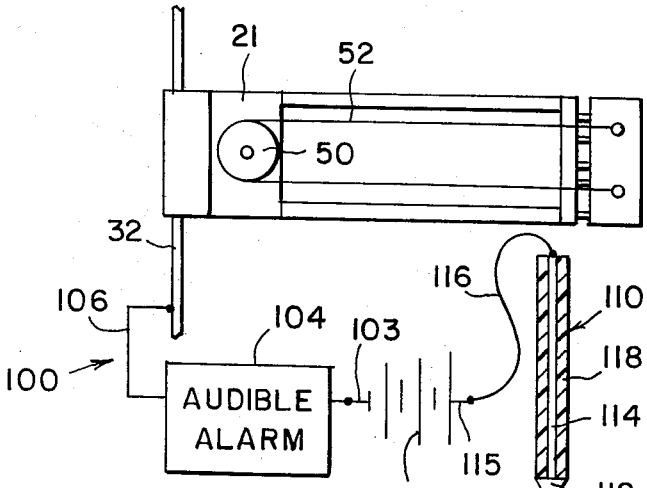
FIG. 12 is a diagram of an electrical circuit including portions of the writing frame, writing implement, battery and audible alarm.

It is possible to provide an audible indication to the writer when the writing implement contacts either the upper or lower string section. For example, if a metallic guitar string is used for the string 52, the writing implement will produce an audible sound when the implement scratches along the ridges of the string. FIG. 12 further shows an electrical circuit 100 including audible alarm means for indicating when the writing implement contacts either string section. A power source 102 such as a battery has one terminal 103 connected in a series circuit with a buzzer, bell or other electrically operable audible alarm device 104. The alarm device 104 is connected by a wire 106 to the metal rod or shaft 32 which is electrically connected to the metal string 52 via electrically the conductive metal frame assembly 21 and the round abutment 50. The writing implement 110 may have an electrically conductive metal tip 112 connected via a metal stem 114 and a flexible wire or cable 116 to the other terminal 115 or the battery 102. The metal stem 112 is preferably enclosed in an insulated casing or housing 118. When the metal tip 112 contacts any point on the string 52, the electric circuit will be completed through the alarm 104 and the alarm will sound.

It should be understood that although the shaft 32 has been illustrated to have detent notches 33 for engagement with the bearing 48 in the end plate 26, if desired the left edge of the baseboard 29 may contain a plurality of laterally spaced notches for engagement with the bearing 48. It should also be understood that if desired the alarm may be actuated by a conventional capacitive or proximity device.

To further assist those having poor vision in writing, the surface of the baseboard 29 has a conventional mat finish so that when the person of poor vision utilizes the aforedescribed writing guide, he will be able to feel the mat finish and know that he has run off the end of the paper.

It should be understood that the foregoing relates to only a limited number of embodiments of the invention which have been by way of example only, and that it is intended to cover all changes and modifications of the examples of the invention herein chosen for the purposes of the disclosure, which do not constitute departures from the spirit and scope of the invention.

What is claimed is:

1. A writing guide, comprising:

a rectangular, flat frame having coplanar, parallel upper and lower rails joined by end plates, and adapted to overlay a sheet on a baseboard;

a string means carried by said end plates and having two spaced string sections disposed between and parallel to said rails to define a space for writing a line on said sheet, said string means being flexible to yield laterally when contacted by a tip of a writing implement, to permit completion of a symbol being written on said sheet;

a flat block disposed adjacent one of said end plates and coplanar therewith;

attachment means engaging ends of said string sections with said block;

guide means extending between said flat block and said one end plate to hold said block in sliding engagement with respect to said frame; and spring means extending between said flat block and said one end plate to permit said block to slide laterally against spring bias when either one of said string sections is flexed laterally.

2. A writing guide as defined in claim 1, further comprising an abutment on the other one of said end plates holding said string means taut.

3. A writing guide as defined in claim 2, wherein said abutment is a round pulley-like member, said string being engaged at a midsection thereof around said member.

4. A writing guide as defined in claim 2, further comprising:

a rod disposed perpendicular to said rails and coplanar therewith, said other end plate being slidably engaged on said rod for moving along said baseboard; and detent means carried by said other end plate for permitting said frame to move along said rod to define spaced lines on said sheet, said frame being rotatable on said rod to facilitate removing and replacing said sheet on said baseboard.

5. A writing guide as defined in claim 2, further comprising pointer means slidably mounted on one of said rails and movable therealong to indicate selected writing points along said rails.

6. A writing guide as defined in claim 2, wherein said string means is a wirewound string having ridges to emit a sound when scratched by said implement to indicate contact between said implement and either one of said string sections.

7. A writing guide as defined in claim 4, wherein said rod, said writing frame, said abutment, and said string means are made of electrically conductive material; and further comprising:

a writing implement having an electrically conductive tip;

an electrical power supply means; and an electrically operable sound emitting device connected in electric circuit with said power supply means, rod, writing frame, abutment, string means, and tip of said writing implement, whereby said device emits a sound when said tip of said writing, implement contacts said string means.

8. A writing guide as defined in claim 7, further comprising pointer means slidably mounted on one of said rails and movable therealong to indicate selected writing points along said rails.

9. A writing guide as defined in claim 8, wherein said abutment is a round pulley-like member, said string being engaged at a midsection thereof around said member.

* * * * *